United States Patent [19]

Theurer

[11] Patent Number: 4,576,095

[45] Date of Patent: Mar. 18, 1986

[54] BALLAST TAMPING MACHINE

[75] Inventor: Josef Theurer, Vienna, Austria

[73] Assignee: Franz Plasser Bahnbaumaschinen-Industriegesellschaft m.b.H., Vienna, Austria

[21] Appl. No.: 648,715

[22] Filed: Sep. 10, 1984

[30] Foreign Application Priority Data

Nov. 2, 1983 [AT] Austria ..... 3874/83

[51] Int. Cl.[4] ..... E01B 27/16

[52] U.S. Cl. ..... 104/12

[58] Field of Search ..... 104/2, 7 R, 7 B, 12

[56] References Cited

U.S. PATENT DOCUMENTS

| | | | |
|---|---|---|---|
| 2,872,878 | 2/1959 | Plasser et al. | 104/12 |
| 3,357,366 | 12/1967 | Plasser et al. | 104/12 |
| 3,653,327 | 4/1972 | Sauterel | 104/12 |
| 4,130,063 | 12/1978 | Theurer et al. | 104/12 |

FOREIGN PATENT DOCUMENTS

| | | |
|---|---|---|
| 704994 | 3/1965 | Canada . |
| 2060035 | 4/1981 | United Kingdom . |
| 2096215 | 10/1982 | United Kingdom . |

*Primary Examiner*—Randolph A. Reese

*Attorney, Agent, or Firm*—Kurt Kelman

[57] ABSTRACT

A ballast tamping machine comprising a machine frame movable along, and extending in the direction of, the track and having guides extending transversely to the machine frame and track, and a tamping tool unit comprising a frame associated with one of the rails and mounted for transverse displacement on the guides, the frame having two pairs of vertical guide columns, a power drive for transversely displacing the frame on the guides, a respective tamping tool carrier mounted on each pair of vertical guide columns for vertical adjustment with respect to the frame, a respective drive for vertically adjusting each one of the tamping tool carriers independently on the pair of vertical guide columns whereon the respective tamping tool carrier is mounted, a respective pair of tamping tools mounted on each one of the tamping tool carriers for immersion at the field side and the gage side, respectively, of the associated rail at a respective point of intersection between the rail and a track tie, a hydraulic drive for independently reciprocating each one of the tamping tools of each one of the pairs of tamping tools, and a respective drive for vibrating the tamping tools of each pair of tamping tools.

8 Claims, 4 Drawing Figures

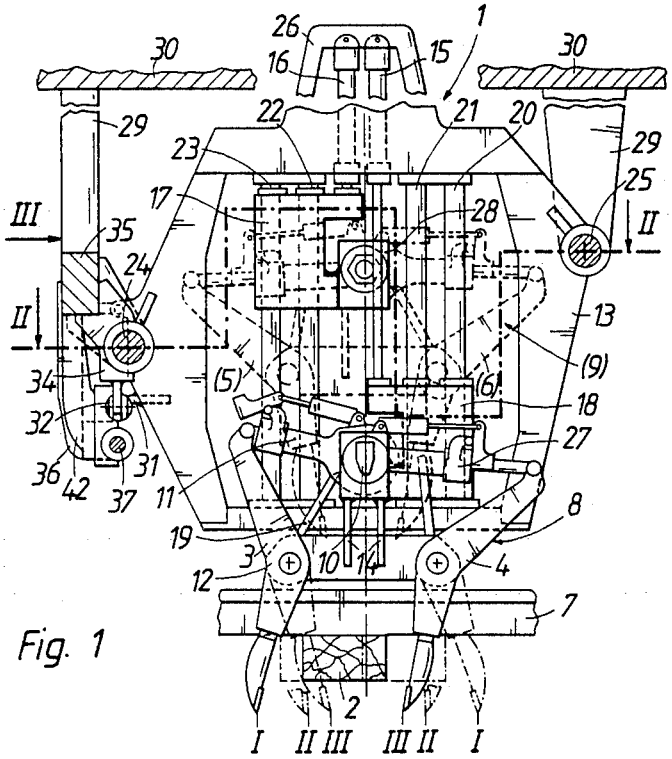
Fig. 1
Fig. 2
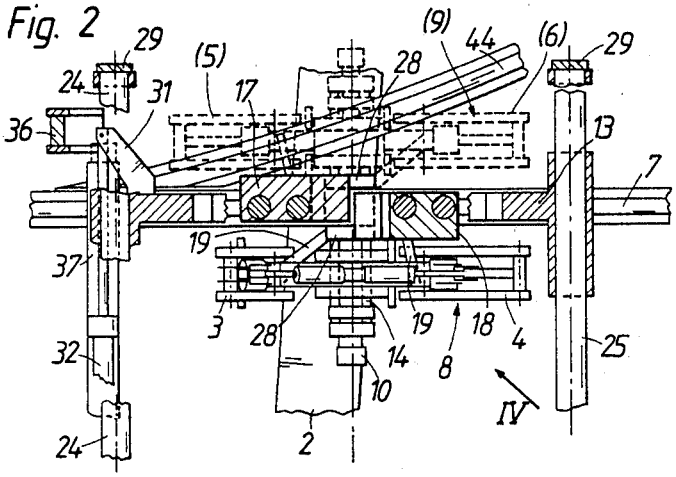

BALLAST TAMPING MACHINE

The present invention relates to a machine for tamping ballast under a respective one of a succession of ties of a railroad track comprised of two rails fastened to the ties at points of intersection therebetween, each track rail having a field side and a gage side, the tamping machine comprising a machine frame movable along, and extending in the direction of, the track and having guide means extending transversely to the machine frame and track, and a tamping tool unit comprising a frame mounted for power-driven transverse displacement on the guide means. Known ballast tamping tool units in such machines comprise vertical guide columns on the frame and a tamping tool carrier mounted on the vertical guide columns for power-driven vertical adjustment with respect to the frame. A respective pair of tamping tools is mounted on the tamping tool carrier for immersion at the field side and the gage side, respectively, of the associated rail at a respective one of the points of intersection. Hydraulic drive means independently reciprocate each one of the tamping tools of each one of the pairs of tamping tools, and a respective drive means vibrates the tamping tools of each pair of tamping tools.

UK patent application No. 2,096,215 A, published Oct. 13, 1982, discloses a machine of this general type and production tampers built with such tamping tool units which operate according to the well known asynchronous tamping principle have been commercially used with great success.

Canadian Pat. No. 704,994, dated Mar. 2, 1965, discloses a tamping tool unit for a mobile ballast tamping machine with pairs of vibratory tamping tools and a reciprocating drive linked to a pivot on the tamping tools. The lower portions of the tamping tools may be pivoted upwardly by a hydraulic drive in a plane extending perpendicularly to the plane of reciprocation of the tools. This enables the tamping tool unit to be used in difficult track sections, such as switches.

UK patent application No. 2,060,035 A, published Apr. 29, 1981, discloses a mobile ballast tamping machine with complete independent tamping units arranged at the field and gage sides of each rail, each unit being vertically adjustable and transversely pivotal. Each tamping unit has a tamping tool carrier and two vibratory and reciprocable tamping tools mounted thereon for immersion in the two cribs adjacent a tie to be tamped. Such machines equipped with a single pair of tamping tools per rail are not only relatively complex in construction but are not successful in practical operations.

U.S. Pat. No. 3,653,327, dated Apr. 4, 1972, deals with a mobile tamper with a cantilevered front end supporting two independent vertically adjustable tamping tool units associated with the respective track rails and linked to the cantilevered front end of the machine by a universal joint. Each one of these tamping tool units is comprised of one pair of vibratory and reciprocable tamping tools respectively arranged at the field and gage side of each rail on a vertically adjustable frame mounted on a transversely pivotal guide column. This high number of tamping tool units, i.e. two per rail, involves considerable construction costs and complex controls. The use of this apparatus in switches is, at best, difficult.

It is the primary object of this invention to provide a ballast tamping machine of the first-described type and useful for switch maintenance operations, which is simply constructed while being rapidly and readily adaptable to a variety of track configurations.

This and other objects are accomplished in such a machine according to the invention by providing two pairs of vertical guide columns on the transversely displaceable frame associated with a respective rail and mounting a respective tamping tool carrier on each pair of vertical guide columns. A respective drive vertically adjusts each tamping tool carrier independently on the two vertical guide columns whereon the respective tamping tool carrier is mounted and a respective pair of tamping tools is mounted on each tamping tool carrier for immersion at the field side and gage side, respectively, of an associated track rail at a respective point of intersection.

This relatively simple arrangement of the tamping tool pairs on their own carriers on a transversely displaceable frame associated with a respective rail advantageously enables the independent lowering and raising of the pairs of tamping tools at each side of the associated rail. By lowering one of the tamping tool carriers of the unit, ballast tamping is possible even in a switch area where a frog or other obstacle makes the lowering of the tamping tools on the other side of the rail impossible. In this manner, the use of the tamping tools may be adapted even to the most difficult switch areas and enable them to tamp the ballast satisfactorily under the ties in such areas. The mounting of each tamping tool carrier on two guide columns provides a solid support resistant to the impact forces generated by the tamping tool operation and comparable to that provided in standard tamping tool units with a single carrier. Furthermore, by mounting the four guide columns on a common frame, the respective pairs of tamping tools are always balanced and centered even if only the tamping tools on one side of the rail are operated while the tamping tools on the other side are at rest. This enables a rapid adjustment to the constantly changing operating conditions in a switch even when the frame is transversely displaced. Since both vertical adjustment drives are simultaneously actuated during tamping operations in tangent track while only one or the other of these drives is actuated in difficult switch areas, the control arrangement is relatively simple.

The above and other objects, advantages and features of the present invention will become more apparent from the following detailed description of a now preferred embodiment thereof, taken in conjunction with the accompanying drawings wherein FIG. 1 is a side elevational view, partly in section and taken in the direction of arrow I of FIG. 3, of one of the tamping tool units associated with one of the rails, the raised tamping tools at the field side of the associated rail being shown in broken lines while the lowered tamping tools at the gage side of the rail are shown in full lines;

FIG. 2 is a sectional view along line II—II of FIG. 1;

Figure 3:
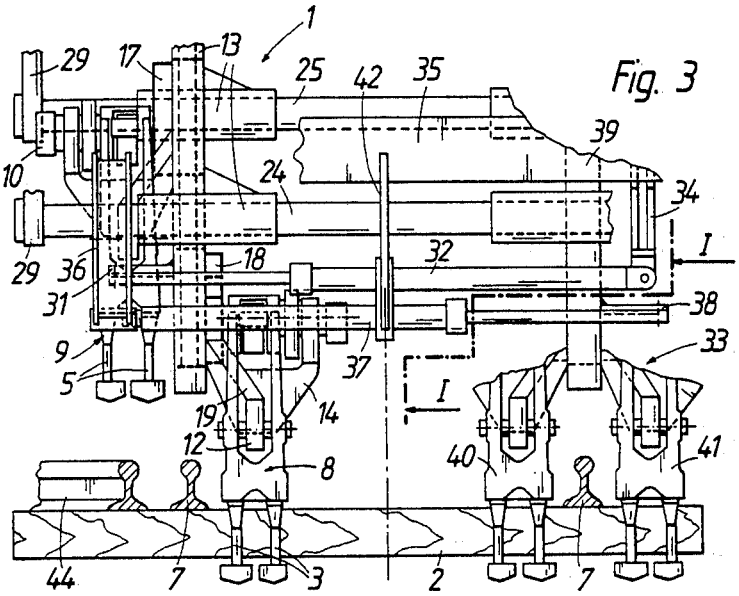
FIG. 3 is a fragmentary front view in the direction of arrow III of FIG. 1 of the two tamping tool units associated with the track rails.

Referring now to the drawing, there is shown machine frame 30 of a machine for tamping ballast under tie 2 of a succession of ties of a railroad track comprised of two rails 7 fastened to the ties at points of intersection therebetween, each track rail having a field side and a gage side, and machine frame 30 being movable along, and extending in the direction of, the track. The machine frame has guide means consisting of horizontal guides 24, 25 extending transversely to machine frame 30 and the track. Tamping tool unit 1 comprises frame 13 associated with one of the rails 7 and mounted for transverse displacement on guide means 24, 25. Tamping tool unit frame 13 has two pairs of vertical guide columns 20, 21 and 22, 23. Power drive means comprising hydraulic cylinder-piston drive 32 is connected to transversely displaceable frame 13 and extends transversely to machine frame 30 for transversely displacing the frame of the guide means. Respective tamping tool carrier 17, 18 is mounted on each pair of the vertical guide columns for vertical adjustment with respect to frame 13. Respective drive 15, 16 is arranged for vertically adjusting each tamping tool carrier independently on the two vertical guide columns whereon the respective tamping tool carrier is mounted. As shown, drives 15, 16 are hydraulic cylinder-piston drives whose cylinders are linked to support bracket 26 of frame 13 while their piston rods are linked to the tops of carriers 17, 18. Respective pairs 8, 9 of tamping tools 3, 4, 5, 6 are mounted on each tamping tool carrier 18, 17 for immersion at the gage side and the field side, respectively, of associated rail 7 at a respective point of intersection with tie 2. Hydraulic drive means 11 is provided for independently reciprocating each tamping tool of each pair of tamping tools and a respective drive means 10 is provided for vibrating the tamping tools of each pair of tamping tools.

Figure 4:
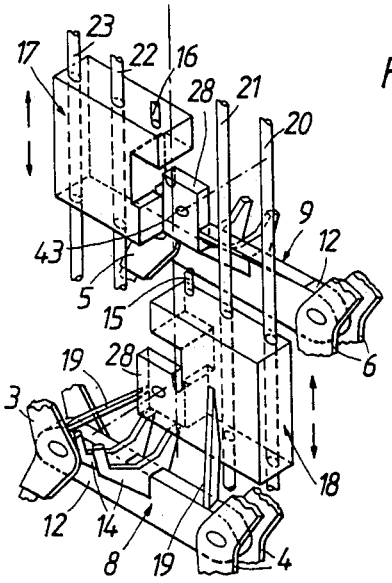
FIG. 4 is a partly schematic perspective view of a tamping tool unit, as seen in the direction of arrow IV of FIG. 2.

As best seen in FIGS. 2 and 4, guide columns 20, 21 and 22, 23 are disposed in a common plane extending in the direction of the track and the pairs of the guide columns are arranged symmetrically with respect to vibrating drive means 10. This structure, wherein the vertical guide columns are aligned in a row, enables the tamping tool unit to be very compact and the symmetrical arrangement assures a uniformly distributed load on transversely displaceable frame 13. The pairs 8, 9 of tamping tools are arranged symmetrically with respect to the common plane and the hydraulically reciprocating drive means 11 comprises two hydraulic cylinder-piston drives respectively connected to each tamping tool of the pairs. In the illustrated embodiment, hydraulically operable opening width limiting device 27 is associated with at least one of the drives for setting different opening widths for the tamping tool reciprocation. Drive means 11 operate according to the well-known asynchronous tamping principle and device 27 consisting of a stop pivotal into engagement with the piston rod of the reciprocating drive may be actuated to change the reciprocating path. This standard tamping tool arrangement for asynchronous tamping in combination with the independently vertically adjustable tamping tool carriers for the tamping tools at respective sides of the associated rail and the capability to change the opening width of the reciprocable tamping tools enables the tamping tool unit of the present invention to be fully adaptable to work in the most difficult track sections. For example, it is possible with this construction to tamp ties which are obliquely positioned in a switch area with both tamping tool units.

In the illustrated embodiment, each pair 8, 9 of tamping tools and associated hydraulic reciprocating drive means 11 and vibrating drive means 10 are supported on two vertically extending carrier plates 14 which extend transversely to the common plane and are connected to respective tamping tool carrier 17, 18. Carrier beam 12 supports the pair of tamping tools with the associated drive means on the two carrier plates 14, two braces 19 connecting the carrier beam to the carrier plates. This mounting of the pairs of tamping tools on the vertically adjustable tamping tool carriers enables the unit to be subjected to very high loads and the vertical arrangement of the carrier plates provides added rigidity and a simple mounting.

As can be seen in FIG. 2, tamping tool carriers 17, 18 are asymmetric with respect to guide columns 22, 23 and 20, 21 whereon they are vertically adjustably mounted. Rectangular, outwardly projecting support plates 28 extend from the facing ends of tamping tool carriers 17 and 18, and these support plates project beyond a center line of symmetry of frame 13. Carrier plates 14 and one of the braces 19 is connected to the support plates. Since support plates 28 are laterally offset from the adjacent tamping tool carrier, independent vertical adjustment of the two tamping tool carriers is possible although the support plates project beyond the center line of symmetry of frame 13, each support plate being capable of gliding past the adjacent tamping tool carrier, as may be clearly seen in FIG. 2.

Horizontal guides 24, 25 extend transversely over the entire width of the track and their ends are supported in brackets 29 on machine frame 30. The machine frame comprises crossbeam 35 connected to brackets 29 and the cylinder end of hydraulic transverse displacement drive 32 is affixed to support arm 34 projecting from the crossbeam in the range of the track rail opposite to the rail associated with frame 13 of tamping tool unit 1. Connecting element 31 is affixed to frame 13 and the piston rod of drive 32 is affixed thereto.

This transverse displacement drive provides a displacement path of considerable length so as to enable the tamping tool units to be well centered over desired tamping spots in switches. This enables all points of intersection of rails and ties to be tamped at track crossings and switches.

The machine further comprises another tamping tool unit 33 (shown only partially) associated with the other one of the track rails. The other tamping tool unit is independently transversely displaceably mounted on guide means 24, 25 and another power drive means 37 similar to hydraulic cylinder-piston drive 32 is provided for transversely displacing tamping tool unit 33 along the transverse guide means. Vertical support arm 36 is affixed to crossbeam 35 and the cylinder end of drive 37 is affixed to the lower end of this support arm. The piston end of the drive is affixed to connecting element 38 of frame 39 of tamping tool unit 33. Frame 39 is transversely displaceable and tamping tool unit 33 is substantially of the same structure as unit 1 so that the pairs 40, 41 of tamping tools may be independently vertically adjusted.

Since the two tamping tool units associated with the respective track rails are independently transversely displaceable, the machine may be used for tamping in even the most difficult track sections, the tamping tools being positionable so that they may be centered with respect to almost any rail position.

Central brace 42 affixed to crossbeam 35 supports the relatively long cylinders of transverse displacement drives 32 and 37 to avoid any danger of buckling of these long drives.

FIG. 4 clearly shows the construction of tamping tool carriers 17, 18 which are vertically adjustably guided on columns 20, 21, 22, 23, pairs 8 and 9 of the tamping tools only being shown fragmentarily in this figure for the sake of clarity. Their connection to the carriers is effected by two carrier plates 14 and braces 19, on the one hand, and a cam shaft, which constitutes the vibrating drive means and is indicated only schematically by a dash-dotted line, journaled in bore 43 of support plate 28, on the other hand. The opposite free end of the vibrating drive means is also supported on carrier plates 14. The two carrier plates and one brace 19 are connected to support plate 28 while the other brace 19 connects support beam 12, which carries the tamping tools, to the carrier.

The positioning of tamping tool pairs 8 and 9 of tamping tool unit 1 in FIG. 3 clearly shows that, even where branch rail 44 branches off a track in a switch area, at least partial tamping is possible with immersed tamping tool pair 8 although the branch rail prevents tamping tool pair 9 from being operated. All that is needed is to center tamping tool pair 8 properly with respect to associated rail 7 by transverse displacement of frame 13 by drive 32 and to operate vertical adjustment drive 15 to lower tamping tool carrier 18. After tamping tools 3, 4 have been immersed in the ballast, reciprocating drives 11 are actuated to squeeze the tamping tools together. A further adjustment is possible by operation of opening width limiting device 27, particularly in the case of obliquely positioned ties in the switch area. As shown in FIG. 1, it may be advantageous to tamp tie 2 so that tamping tool 3 is fully opened to end position I while tamping tool 4 is moved from intermediate position II to end position III. Due to the asynchronous tamping provided by the independent reciprocation of the tools of each pair, the full tamping pressure is exerted by one of the tools, regardless of the fact that an obstacle may be in the way of the reciprocating path of the opposite tool and prevent it from operating fully. FIG. 1 shows how the adjustment of the opening width of the tamping tools enables differently positioned ties (see broken and dash-dotted lines) to be tamped.

What is claimed is:

1. A machine for tamping ballast under a respective one of a succession of ties of a railroad track comprised of two rails fastened to the ties at points of intersection therebetween, each track rail having a field side and a gage side, the tamping machine comprising a machine frame movable along, and extending in the direction of, the track and having guide means extending transversely to the machine frame and track, and a tamping tool unit comprising (a) a frame associated with one of the rails and mounted for transverse displacement on the guide means, the frame having two pairs of vertical guide columns disposed in a common vertical plane defined by the associated rail, (b) power drive means for transversely displacing the frame on the guide means, (c) a respective tamping tool carrier mounted on each pair of vertical guide columns for vertical adjustment with respect to the frame, (d) a respective drive for vertically adjusting each one of the tamping tool carriers independently on the pair of vertical guide columns whereon the respective tamping tool carrier is mounted, (e) a respective pair of tamping tools mounted on each one of the tamping tool carriers for immersion at the field side and the gage side, respectively, of the associated rail at a respective one of the points of intersection, (f) hydraulic drive means for independently reciprocating each one of the tamping tools of each one of the pairs of tamping tools, and (g) a respective drive means for vibrating the tamping tools of each pair of tamping tools.

2. The ballast tamping machine of claim 1, wherein the pairs of the guide columns are arranged symmetrically with respect to the vibrating drive means.

3. The ballast tamping machine of claim 2, wherein the pairs of tamping tools are arranged symmetrically with respect to the common plane and the hydraulic reciprocating drive means comprises a respective hydraulic cylinder-piston drive connected to each tamping tool of the pairs.

4. The ballast tamping machine of claim 3, further comprising a hydraulically operable opening width limiting device associated with at least one of the drives for setting different opening widths for the tamping tool reciprocation.

5. The ballast tamping machine of claim 2, further comprising two vertically extending carrier plates supporting each one of the pairs of tamping tools and associated ones of the hydraulic reciprocating drive means and vibrating drive means, the carrier plates extending transversely to the common plane and being connected to a respective one of the tamping tool carriers.

6. The ballast tamping machine of claim 1, wherein the power drive means comprises a hydraulic cylinder-piston drive connected to the transversely displaceable frame and extending transversely to said direction.

7. The ballast tamping machine of claim 6, wherein the machine frame comprises a crossbeam and the cylinder end of the hydraulic drive is affixed to the crossbeam in the range of the track rail opposite to the track rail associated with the transversely displaceable frame of the tamping tool unit.

8. The ballast tamping machine of claim 1, further comprising another tamping tool unit associated with the other one of the track rails and mounted for transverse displacement on the guide means independently of the transverse displacement of the frame, and another power drive means for transversely displacing the other tamping tool unit along the guide means.

* * * * *